United States Patent [19]

Jurkovic et al.

[11] Patent Number: 4,527,414

[45] Date of Patent: Jul. 9, 1985

[54] CRIMPING MACHINE WITH SPLIT DIE RING

[75] Inventors: Paul J. Jurkovic, Euclid; George C. Burrington, Eastlake, both of Ohio

[73] Assignee: Parker Hannifin Corporation, Cleveland, Ohio

[21] Appl. No.: 547,706

[22] Filed: Nov. 1, 1983

[51] Int. Cl.[3] ..... B21D 41/04

[52] U.S. Cl. ..... 72/402; 29/237

[58] Field of Search ..... 72/402, 416, 412, 453.01; 29/237, 283.5, 282

[56] References Cited

U.S. PATENT DOCUMENTS

| | | | |
|---|---|---|---|
| 3,750,452 | 8/1973 | Frank | 72/402 |
| 3,851,514 | 12/1974 | Chen et al. | 72/402 |
| 4,034,592 | 7/1977 | Chen et al. | 29/237 |
| 4,050,286 | 9/1977 | Gasier et al. | 72/416 |
| 4,071,936 | 2/1978 | Smith | 72/402 |
| 4,285,228 | 8/1981 | Gunning | 72/402 |
| 4,309,892 | 1/1982 | Currie | 72/402 |
| 4,357,822 | 11/1982 | Patel | 72/402 |

*Primary Examiner*—Daniel C. Crane
*Attorney, Agent, or Firm*—Joseph B. Balazs

[57] ABSTRACT

A crimping machine for attaching metal hose couplings to flexible hose includes a hydraulic actuator for forcing a circular array of die segments toward the narrow end of a tapered opening in the base of the machine in order to radially constrict the die segments and the coupling. The die segments are supported on a die separator in the machine and may be joined into two groups of segments, each individually removeable from the machine to facilitate loading and unloading of the hose couplings. A die ring is placed over the die segments to assure simultaneous movement thereof and to limit the stroke of the actuator, as a crimp diameter limiting device. The die ring is split into halves to facilitate loading. One half of the die ring is removeable and the mating half is slidably mounted on the actuator so as to remain in position over one group of die segments upon retraction of the actuator. An adapter bowl is also disclosed for a smaller range of hose couplings.

8 Claims, 8 Drawing Figures

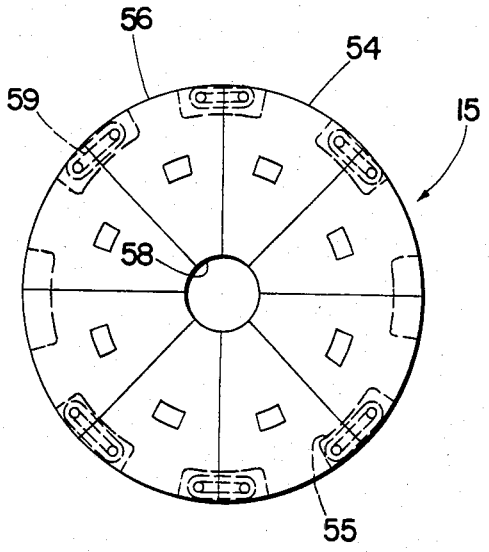
Fig. 5
Fig. 7
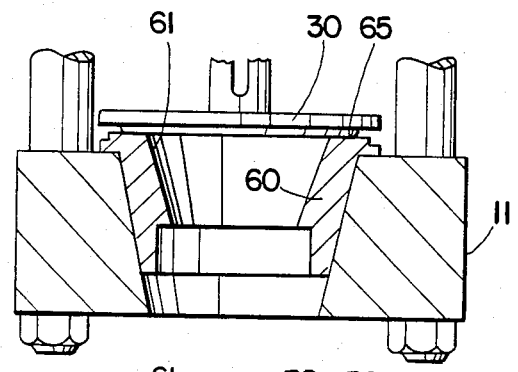
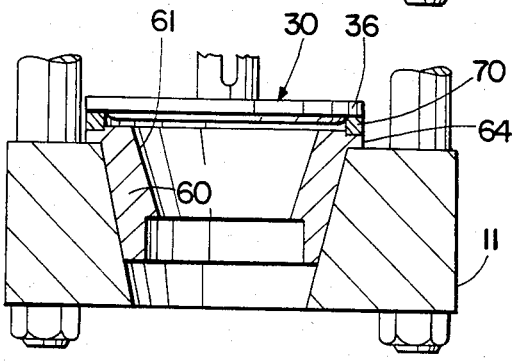
Fig. 8
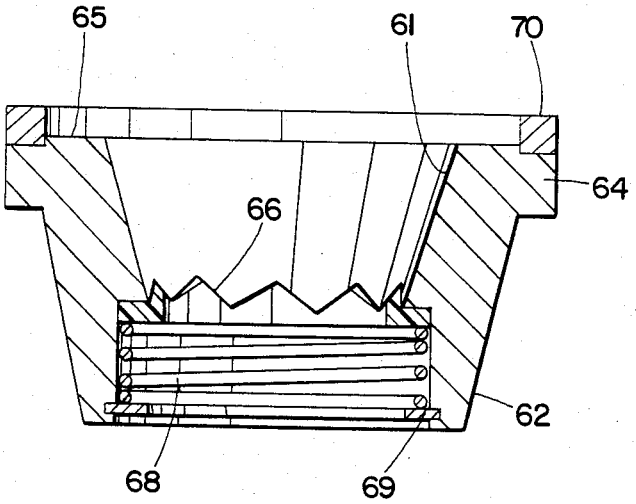
Fig. 6

CRIMPING MACHINE WITH SPLIT DIE RING

BACKGROUND OF THE INVENTION

This invention relates to crimping machines and more particularly to an improvement in such machines wherein a split die ring is used to transmit crimping forces from the hydraulic actuator to a circular array of die segments.

This invention is an improvement on the type of crimping machine disclosed in U.S. Pat. No. 4,309,892 and which is incorporated herein by reference. In such prior art machine, hose assemblies are formed by forcing a circular array of die segments into a tapered bowl by means of a hydraulic actuator. A pusher is affixed to the operating end of the actuator and is designed with an opening therein to allow placement of bent hose ends in the crimping machine. A pusher plate is positioned over the die segments and is contacted by the pusher to transmit force to all of the die segments simultaneously, while also being used as a device to limit the stroke of the actuator and thus the final crimp diameter.

In machines of this type the hose with hose coupling frictionally engaged thereon is inserted and removed from the bottom, through the die separator and the tapered bowl. Crimping die segments and the pusher plate may already be in position in the bowl or may be placed therein about the inserted hose coupling and the actuator activated to complete the crimp. In larger size machines it becomes very unwieldly for the operator to support the hose and coupling, to set the die segments and pusher plate and to activate the machine. In some instances, with space at a premium in the crimping zone, it would be impractical to size the machine to allow sufficient space to place the die segments and to snake the pusher plate over the hose end without interfering with the pusher or other components of the machine.

Prior art machines have accommodated this problem in various ways. In one group of machines the pusher is arranged in sections which may be swung away from the crimping zone to clear the area for loading and unloading. This is described in U.S. Pat. No. 3,851,514. In another form of device an elongated bed plate is utilized so that the crimping bowl may be shifted between operating and loading positions. This is described in U.S. Pat. No. 3,750,452. In the type of machine described in the U.S. Pat. No. 4,309,892, noted above, both the hydraulic actuator and the pusher are rocked out of the working zone. These prior art solutions, however, introduce a degree of instability which is undesirable in equipment exposed to the extremely high forces encountered in large size crimping machines.

SUMMARY OF THE INVENTION

The crimping machine of this invention obviates these problems to a great extent in the provision of a split pusher plate or die ring used in conjunction with a set of die segments which may be placed or removed from their crimping location in the machine in sections. Further, the die ring is arranged so that one-half of the complete ring is slidably mounted on the pusher attached at the end of the hydraulic actuator, so that the ring half may be retained in position over a portion of the die segments, even though the pusher is retracted for clearance purposes. With the die ring arranged in this manner, the operator may more readily place the hose and hose end in position for crimping, locate the die segments and fit the second half of the die ring, prior to activation of the pusher. Further, the pusher need only be retracted sufficiently to accommodate this placement of components, which is much less a retraction than would be necessary with an integral die ring.

The split die ring is preferably formed of half-circle sections to cooperate with die segment sets also arranged in half-circle arrays. One die ring half is removable from the machine while the other half is slidably connected to the pusher to be movable relative thereto, but to be oriented in position over a half-circle array of die segments, the latter located in the tapered opening of the base plate of the machine and supported therein by a spring-locked die separator. Both of the die segment half-circle arrays may be removed from the machine for replacement by other size arrays or for providing clearance for locating a hose coupling for crimping purposes. This is accommodated by moving the slidable die ring half upwardly on the pusher to a clearance position, and securing same at that location by a detent device. At other times the die ring half is lowered into contact with a die segment half-circle array and remains in contact therewith throughout the range of motion of the pusher by virtue of a slotted plate interconnection therewith.

When crimping straight hose ends of the same size, it is not necessary to remove the die segments as only a slight upward movement will provide sufficient radial expansion thereof to allow the hose end to be introduced or removed. The slotted interconnection of the die ring half allows the entire die ring to follow this motion without the necessity for removing same from the machine.

A further aspect of this invention is the provision of an adapter bowl which allows crimping of a smaller range of hose couplings in the same machine. The adapter bowl fits into the tapered opening of the base plate and includes a smaller tapered opening therein for accommodating a smaller set of crimping dies. The adapter bowl includes its own die separator and is compatible with the die ring arrangement of the machine and utilizes a spacer ring for predetermination of an additional final crimp diameter with the same set of die segments.

BRIEF DESCRIPTION OF THE DRAWINGS

FIG. 5 is a plan view of the die segment assembly in a contracted position, representative of the completion of a crimping cycle;

FIG. 6 is a cross sectional view in elevation of the adapter bowl of the invention;

FIG. 7 is a partial sectional view of a portion of the crimping machine with parts removed, showing the adapter bowl in the die block and the split die ring at its lowermost predetermined position;

FIG. 8 is a view similar to that of FIG. 7 showing a spacer ring used in conjunction with the adapter bowl and die ring to achieve a second predetermined lowermost position.

DESCRIPTION OF THE INVENTION

Figure 1:
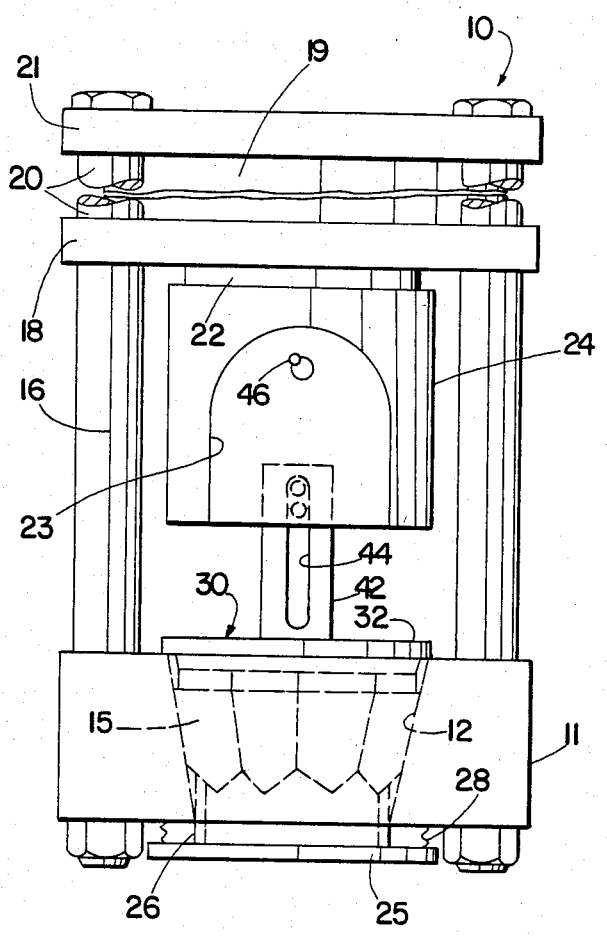
FIG. 1 is a front view of the crimping machine with pusher elevated and with die ring at its lowermost position, at the completion of a crimp cycle.
Figure 2:
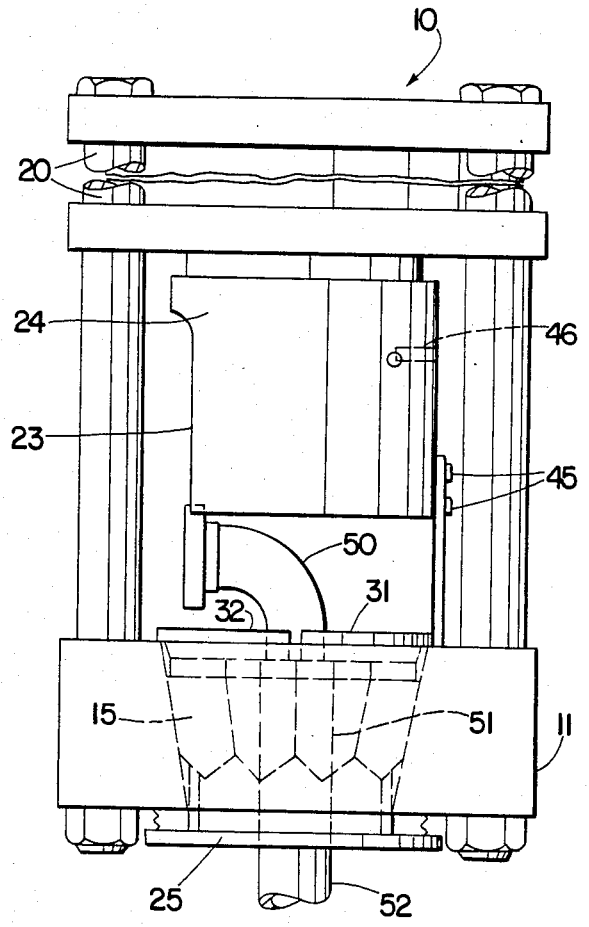
FIG. 2 is a side view of the crimping machine with pusher elevated showing a bent end hose coupling therein at the completion of a crimp cycle.

Referring initially to FIGS. 1 and 2 there is shown the crimp machine 10 of the invention in front and side elevations respectively, with parts generally depicted at the completion of a crimping cycle. The crimp machine 10 consists generally of a rectangular base plate 11 having a centrally located tapered opening or throughbore 12 adapted for receipt of a die segment array 15, shown in dashed lines. Tapered opening 12 has its largest diameter at the upper end of base plate 11 and the smaller opening at the lower portion thereof so that as the die segment array 15 is urged toward the narrow end of the opening 12, the array is radially and circumferentially constricted to achieve the crimping action.

Crimp machine 10 further includes tie rods 16 which support the head plate 18 of hydraulic cylinder 19 in turn having tie rods 20 and base plate 21, which together with piston 22 forms the hydraulic actuator for the machine. Actuator 22 is a conventional hydraulic cylinder powered from a source of fluid under pressure to develop an extremely high crimping force at the piston, which may be on the order of approximately 100 tons. Attached to piston 22 for movement therewith is pusher 24 which consists of a generally hollow cylindrical member having a cutout portion 25 at its forward end to provide clearance for bent hose couplings and the like.

Crimp machine 10 further includes die separator 25 which is used to support die segment array 15 prior to and during a portion of the crimp cycle. Die separator 25 consists of a plate having a hole at the central portion thereof and a tubular support 26 extending upwardly through the narrow end of tapered opening 12 into engagement with the lower faces of the die segments in array 15, the tubular support 26 having a saw tooth edge at the upper portion to provide circumferential spacing for the individual die segments. Die separator 25 is resiliently mounted to the base plate 11 by means of springs 28 to allow axial movement of the die separator 25 in the tapered opening 12.

Figure 3:
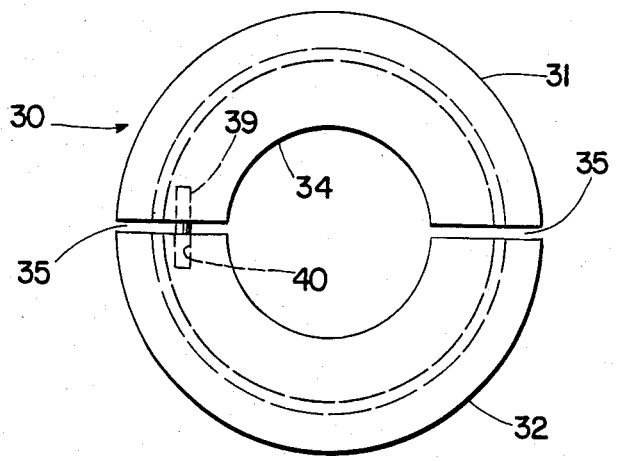
FIG. 3 is a plan view of the split die ring of the invention.
Figure 4:
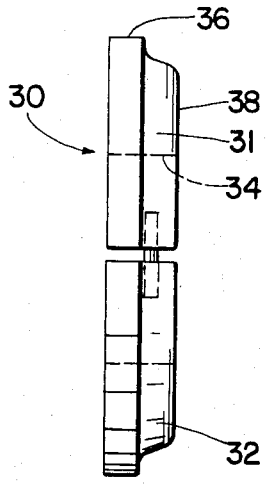
FIG. 4 is a side view of the split die ring.

Crimp machine 10 further includes die ring 30 consisting of a slidable die ring section 31 and removable die ring section 32. As seen more clearly in FIGS. 3 and 4 die ring 30 is of a generally circular configuration consisting of the half sections 31, 32, in this embodiment of the invention each being approximately one-half of a full circle, being split at 35. The die ring 30 is generally in the configuration of a circular metal plate having a peripheral shoulder 36 and a lesser diameter arcuate lower flange 38, the latter adapted to be received within the larger end of tapered opening 12 as depicted in FIGS. 1 and 2. Central opening 34 in die ring 30 is provided to allow for access to the center of die segment array 15.

Slidable die ring section 31 includes pin 39 press fit into one face thereof at split 35 for cooperation with opening 40 in removable die ring section 32. By this device removable die ring section 32 may be placed adjacent slidable die ring section 31 to form the circular configuration for the die ring and to locate same at the opening to the tapered opening 12 in the base plate 11. It will be noted that the periphery of flange 38 is generally of conical configuration so as to fit within tapered opening 12 thereby to assure that die ring 30 is generally of a circular configuration in order to conform to the configuration of die segment array 15.

Slidable die ring section 31 is mounted for sliding movement relative to pusher 24 by means of rectangular plate 42 having elongated slot 44 therein. Plate 42 is welded to slidable die ring section 31 and extends upwardly adjacent the rear portion of pusher 24 being slidably secured thereto by means of bolts 45 received in slot 44. Bolts 45 are axially aligned and a fairly close fit within slot 44 so as to serve as a guide for movement of plate 42 in a generally axial direction. Thus, as may be seen in FIGS. 1 and 2, die ring 30 may be elevated from the lowermost position indicated, to a position abutting the lower end of pusher 24 to provide clearance at the entrance to tapered opening 12 for placement and removal of die segment array 15 and the like. Slideable plate 42 may be retained in this uppermost position by a detent device consisting of pin 46 slidably received in a transverse hole in pusher 24 which can be extended to engage the upper end of slot 44. In the released position, however, it will be apparent that with die ring 30 at its lowermost position, as depicted in FIGS. 1 and 2, pusher 24 is free to move from the upper position depicted to a lower position in engagement with the upper surface of die ring 30 so as to urge die ring 30 and the die segment array 15 downwardly into tapered opening 12. As noted in FIG. 2 a bent hose end 50 having metal collar 51 thereon is frictionally engaged with the free end of hose 52 and the assembly positioned within die segment array 15 for crimp purposes. Pusher 24 includes opening 23 therein to provide clearance for the bent hose end 50 and it will be apparent that the thus open end of pusher 24 is closed by the generally fully circular configuration of die ring 30 through the intermediacy of removable die ring section 32, although die ring sections 31 and 32 are indicated as generally of half-circle extent, some variation is possible in this arrangement dependent in part upon the configuration of die segment array 15.

Refering now to FIG. 5, the die segment array 15 is shown as two half-circle arrays of die segments 54 and 55, each half-circle array consisting of four identical die segments of generally triangular shape having a tapered outer surface generally conforming to the taper of the opening 12 in base plate 11 and an inner surface 58 generally forming a section of a cylindrical surface adapted for engagement and crimping of the cylindrical collar 51 of a hose coupling. Adjacent die segments in each of the half-circle arrays 54, 55 are joined to one another by means of links 59 joining axially disposed pins. When removed from the machine the half-circle arrays 54, 55 may be opened and replaced about the collar 51 of a hose end when the latter is disposed in the crimp machine 10. Adjacent segments of the respective half-circle arrays, 54, 55 do not include links so that the arrays may be fully separated from one another, although in some instances it will be preferable to include a link in at least one of these locations so as to retain all of the die segments of a particular array in a common chain so as to avoid mismatching, wrong size selection and the like.

Thus, as seen in FIGS. 1 and 2 the following operation of the crimp machine 10 obtains. Hose end 50 with hose 52 attached may be introduced to crimp machine 10 through die separator 25 and the tapered opening 12 in base plate 11 and placed generally in the position depicted in FIG. 2. For this purpose pusher 24 may be retracted to the full up position depicted while slidable die ring section 31 may be raised to an uppermost position and retained there by slidable pin 36. Thereafter an appropriate die segment array 15 is fitted about the collar 51 of hose end 50 being supported and properly circumferentially spaced by die separator 25. Die segment array 15 is arranged so that one half-circle array of segments 54 is disposed under slidable die ring half 31 so that the latter may be moved to a lower position abutting the die segment array 54 to releasably retain the latter in position. The remaining half-circle array of die segments 55 and removable die ring section 32 may thereafter be placed in position, the latter being oriented by placement of opening 40 over pin 39 in the slidable die ring section.

With the hose end 50 thus supported in position in crimp machine 10, hydraulic actuator 22 is activated to move pusher 24 downwardly into engagement with die ring 30 driving the latter and die segment array 15 toward the narrow end of tapered opening 12 causing a radial constriction of the individual die segments and a crimping of the collar 51 onto inserted hose end 52. During this movement die separator 25 is moved downwardly from the narrow end of tapered opening 12. The crimp is completed when shoulder 36 of die ring 30 engages upper surface of base plate 11 preventing any further movement of pusher 24 and thus of actuator 22, which condition can be recognized by the operator either visually or by sensing an increse in pressurization in the hydraulic actuator system.

Upon completion of the crimp pusher 24 may be retracted to the uppermost position indicated in FIGS. 1 and 2 and the removable die ring 32 and die segment half-circle array 35 removed from the machine as necessary to allow removal of hose end 50 and placement of a succeeding part. In some instances, and particularly with straight hose ends such full retraction of pusher 24 and removal of die section 32 and/or die segment half-circle array 35 may not be necessary as with partial lifting of such components the central opening of the die segment array 15 will become sufficiently large to allow removal and replacement of succeeding hose ends.

The crimp machine 10 depicted is designed for relatively large fittings and in order to accommodate smaller size ranges an adapter bowl 60 is provided. Adapter bowl 60 includes tapered opening 61 therein and has an outer tapered surface 62 generally conforming to tapered opening 12 in base plate 11 so that adapter bowl 60 may be snugly seated therein. Shoulder 64 of adapter bowl 60 is adapted to rest against the upper surface of base plate 11 to limit the depth of entry of adapter bowl 60 into tapered opening 12 and to provide a surface for determination of final crimp diameters. Adapter bowl 60 further includes upper surface 65 and an integral die separator 66 similar in configuration to die separator 25 of the crimp machine 10, being spring loaded as well by coil spring 68 held in position in the lower position of bowl 60 by means of retainer 69. A further spacer ring 70 is removable from adapter bowl 60 and is adapted to be positioned on the upper surface of shoulder 64 for selection of different crimp diameters.

As seen more clearly in FIGS. 7 and 8, wherein only a portion of crimp machine 10 is shown adapter bowl 60 is disposed in base plate 11 in position for the crimping of one size of hose couplings. In this arrangement, die ring 30 is moved downwardly by means of pusher 24 until engagement is made by the lower surface of flange 38 with upper surface 65 of adapter bowl 60 thereby limiting the depth of penetration of an array of die segments into the tapered opening 61 of adapter bowl 60 thereby determining the final crimp diameter of such die segments.

In an optional arrangement as depicted in FIG. 8 spacer ring 70 is placed in position on shoulder 64 of adapter bowl 60 so that the shoulder 36 of die ring 30 engages the spacer ring 70, thereby predetermining a higher stop position and a greater final crimp diameter for an array of die segments disposed within tapered opening 61. By means of different thickness spacer rings 70 varying crimp diameters can be accomplished with a common set of die segments.

What is claimed is:

1. Apparatus for radially crimping the collar of a hose coupling onto a hose end comprising a base plate, a hydraulic actuator, means supporting said actuator for axial movement toward and away from said base plate, said base plate having a tapered opening therein, a plurality of die segments received in said opening, a resiliently mounted die separator also received in said opening, said die separator supporting said die segments in a circular array and adapted for axial movement, a pusher member on said hydraulic actuator for transmitting movement of said hydraulic actuator to said die segments for axially urging said die segments toward the narrow end of said tapered opening to cause radial contraction thereof, a die ring interposed between said pusher member and said die segments for transmitting movement of said pusher member to all of said die segments to assure simultaneous movement of said die segments, said die ring being split into separable parts to facilitate loading and unloading of said hose coupling in said die segments, engagement means on said die ring for limiting axial movement of said die ring and said pusher thereby to limit radial inward contraction of said die segments, and means for securing said separable parts of said die ring in a generally circular configuration to assure contact with all of said die segments, said securing means comprising a ridge on said separable parts for engagement with said die segments, said ridge being arcuate and adapted for receipt within said tapered opening.

2. Apparatus as set forth in claim 1 wherein said securing means further comprises a pin on one of said separable parts adapted for receipt in a mating hole in the other of said separable parts, thereby assuring that said separable parts form a generally circular ring.

3. Apparatus for radially crimping the collar of a hose coupling onto a hose end comprising a base plate, a hydraulic actuator, means supporting said actuator for axial movement toward and away from said base plate, said base plate having a tapered opening therein, a plurality of die segments received in said opening, a resiliently mounted die separator also received in said opening, said die separator supporting said die segments in a circular array and adapted for axial movement, a pusher member on said hydraulic actuator for transmitting movement of said hydraulic actuator to said die segments for axially urging said die segments toward the narrow end of said tapered opening to cause radial contraction thereof, a die ring interposed between said pusher member and said die segments for transmitting movement of said pusher member to all of said die segments to assure simultaneous movement of said die segments, said die ring being split into separable parts to facilitate loading and unloading of said hose coupling in said die segments, engagement means on said die ring for limiting axial movement of said die ring and said pusher thereby to limit radial inward contraction of said die segments, and means mounting one of said separable parts of said die ring for predetermined movement relative to said die segments, said mounting means comprising an axial slide connection between said one separable part and said pusher, whereby said separable part may be retained in place on said die segments as said pusher is moved toward and away from said die segments, said slide connection comprising a plate affixed to said one separable part and extending axially adjacent said pusher, said plate having an axial slot therein for sliding receipt of a guide on said pusher.

4. Apparatus as set forth in claim 3 wherein said guide is axially extended in said slot to assure axial travel of said one separable part.

5. Apparatus as set forth in claim 4 further including detent means on said pusher for releasably locking said slide and said one slidable part to said pusher for movement therewith.

6. Apparatus as set forth in claim 5 wherein said detent means comprises a pin slidably mounted in said pusher and adapted to engage said slot in said plate only when said plate is raised to its uppermost position relative to said pusher.

7. Apparatus for radially crimping the collar of a hose coupling onto a hose end comprising a base plate, a hydraulic actuator, means supporting said actuator for axial movement toward and away from said base plate, said base plate having a tapered opening therein, a plurality of die segments received in said opening, a resiliently mounted die separator also received in said opening, said die separator supporting said die segments in a circular array and adapted for axial movement, a pusher member on said hydraulic actuator for transmitting movement of said hydraulic actuator to said die segments for axially urging said die segments toward the narrow end of said tapered opening to cause radial contraction thereof, a die ring interposed between said pusher member and said die segments for transmitting movement of said pusher member to all of said die segments to assure simultaneous movement of said die segments, said die ring being split into separable parts to facilitate loading and unloading of said hose coupling in said die segments, and an adapter bowl received in said tapered opening for crimping smaller size hose couplings, said adapter bowl having a central tapered opening therein for receipt of die segments and further including means thereon for limiting movement of said pusher.

8. Apparatus as set forth in claim 7 wherein said limiting means comprises a peripheral flange on said adapter bowl adapted for seating engagement with the upper surface of said base plate, and further comprising a spacer ring seated on said flange for engagement by said die ring for limiting the final crimp diameter of said hose coupling.

* * * * *